United States Patent [19]

Hakes

[11] Patent Number: 4,554,984

[45] Date of Patent: Nov. 26, 1985

[54] DRILL BOX SUPPORT MECHANISM FOR MINING BOLTER MACHINES

[75] Inventor: Gary A. Hakes, Bristol, Va.

[73] Assignee: Ingersoll-Rand Company, Woodcliff Lake, N.J.

[21] Appl. No.: 674,781

[22] Filed: Nov. 26, 1984

[51] Int. Cl.[4] ..... E21C 11/00

[52] U.S. Cl. ..... 175/170; 175/203

[58] Field of Search ..... 175/220, 219, 170, 171, 175/202, 203, 62; 173/39, 148; 405/259; 299/11, 33, 91

[56] References Cited

U.S. PATENT DOCUMENTS 2,673,452 3/1954 Glaze ..... 405/259 X 2,850,937 9/1958 Ralston ..... 405/259 X 3,646,553 2/1972 Conkle ..... 405/259 X 3,830,318 8/1974 Busby et al. ..... 175/203 X

*Primary Examiner*—Stephen J. Novosad

*Assistant Examiner*—David J. Bagnell

*Attorney, Agent, or Firm*—R. J. Falkowski

[57] ABSTRACT

A drill box support mechanism for a mining bolter machine is driven by a hydraulic motor and drives a drill steel through a drill chuck. The drill box is supported on a support plate by a spring washer that extends over a central lip at the bottom of the drill box. A rod descends downwardly from the drill box offset from the center of rotation and engages a hole in the support plate.

14 Claims, 5 Drawing Figures

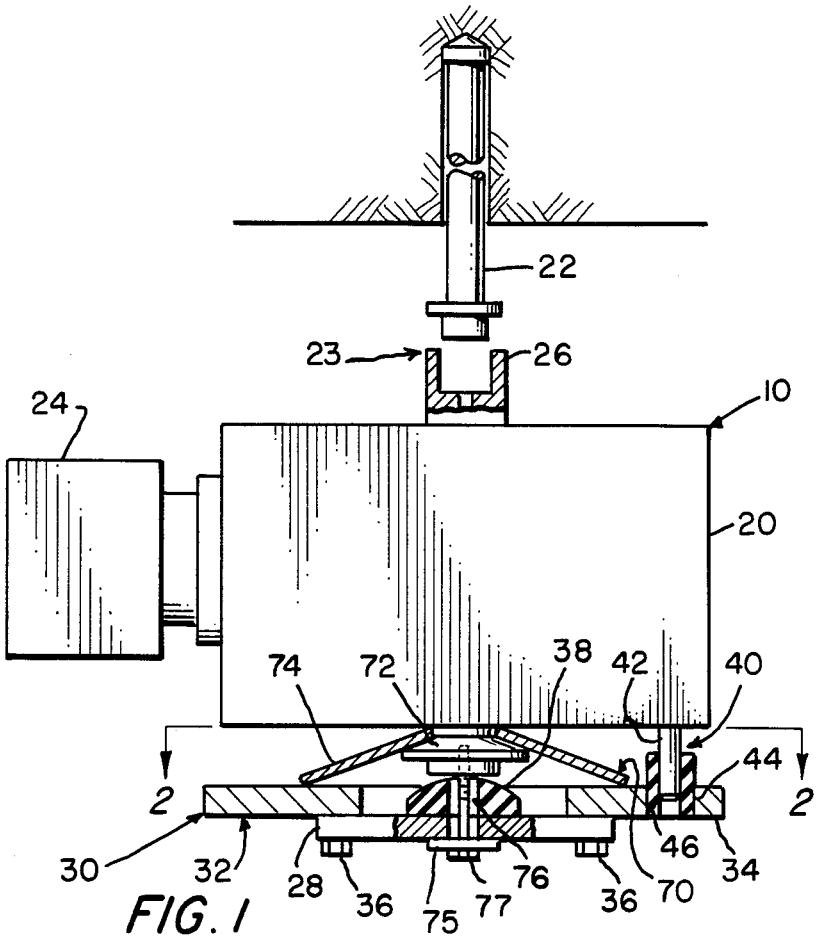
FIG. 1
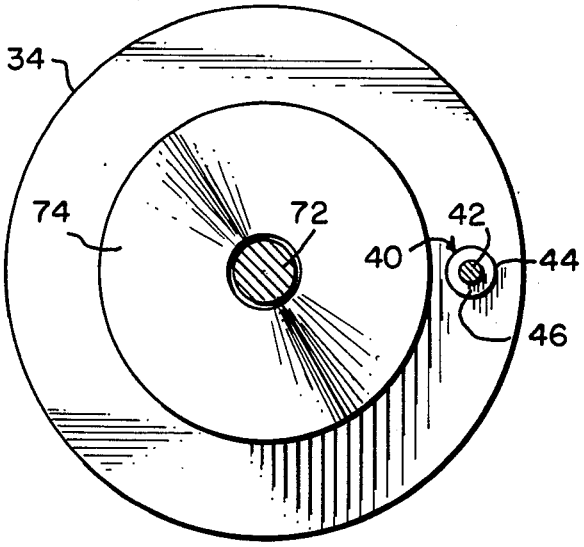
FIG. 2
FIG. 3
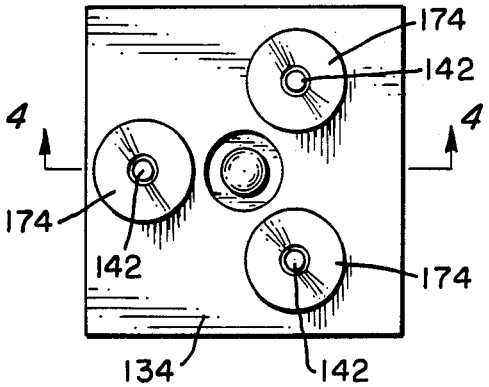
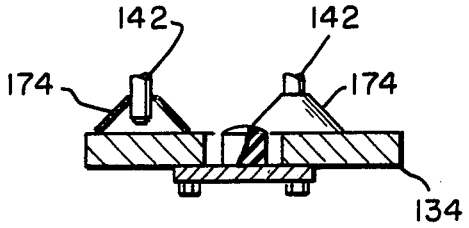
FIG. 4

DRILL BOX SUPPORT MECHANISM FOR MINING BOLTER MACHINES

This invention relates to mining bolter machines used in drilling holes and inserting bolts in mine roofs, particularly to drill boxes used on such machines.

Mining bolter machines are used in the mining industry for drilling holes in the roof and sidewalls of mines and inserting roof bolts at intervals to prevent collapse of the roof and reduce falling debris. The mining bolter machine moves within the mine and drills, usually vertically, by inserting a drill steel moving upwardly. An essential element of the mining bolter machine is a drill box that rotates the drill steel for the drilling of the holes.

The drill box is supported on the machine and has a drill chuck that receives the drill steel and is rotated by a hydraulic motor. The drill box is supported on a support structure that is moved vertically to provide the drilling action. Typically in the prior art a parallelogram linkage between the main part of the mining bolter machine and the support structure keeps the drill box generally level as it is raised toward the roof.

However, when drilling there is often a deviation from the straight line expected for the passage of the drill steel into the roof because a misalignment of varying amounts develops between the drill chuck center of rotation and the drill steel center line as it moves upwardly. This misalignment deflects the drill steel and creates considerable stress that is a major cause of wear and damage to the drill steel and the drill chuck. In some cases it may break the drill steel which may also cause damage to property or injury to personnel in the vicinity.

This misalignment has been relieved occasionally by the addition of a compressible linkage or similar device in the parallelogram linkage supporting the drill box structure. These linkages have generally been found to be expensive to manufacture and difficult to maintain. They also are not as flexible radially or angularly as desired.

With this invention a drilling mechanism is provided that is flexible radially and angularly, is relatively inexpensive to construct and maintain, and is generally adaptable to be usable on all types of drill box arrangements.

Other advantages of the invention will be apparent from the following description.

FIG. 1 is a simplified side-view of a drilling mechanism according to this invention;

FIG. 2 is a top view taken along line II—II in FIG. 1;

FIG. 3 is a top view of a portion of a drill support plate showing another drilling mechanism according to this invention;

FIG. 4 is a side view taken along line IV—IV in FIG. 3;

Figure 5:
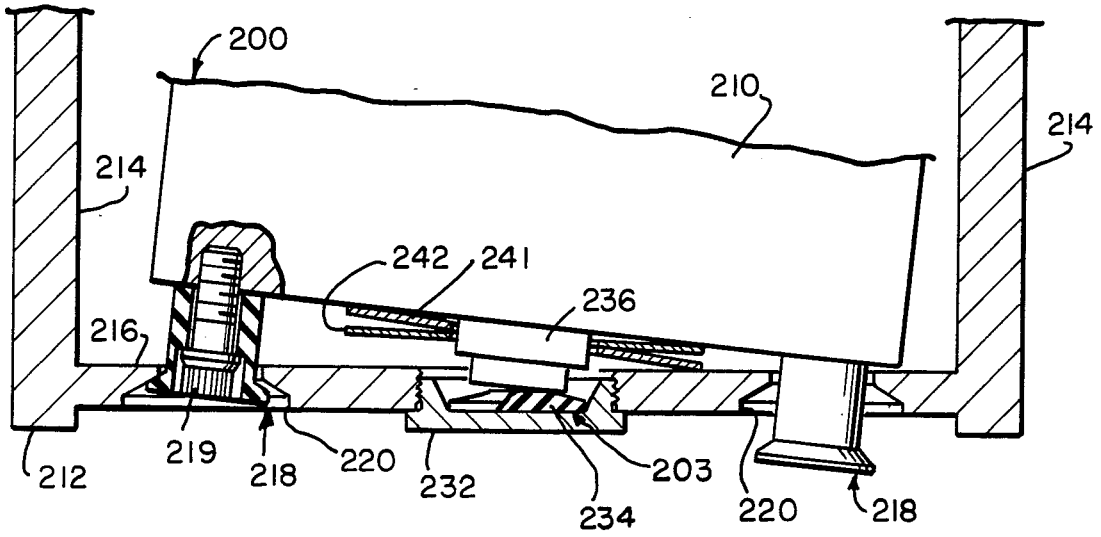
FIG. 5 is a simplified partial side view of another drilling mechanism according to this invention.

Referring to FIGS. 1 and 2, a drilling mechanism 10 has a main body or drill box 20 of any known type, a vertically extending drilling steel 22, a means 23 for rotating the drill steel, and a means 30 for supporting the drill box.

The means for rotating drill steel 22 comprises a hydraulic motor 24 mounted on drill box 20 and a drill chuck 26 of any known type connected to be driven by hydraulic motor 24 in any manner known in the art.

Means 30 for supporting the drill box comprises a bottom support structure 32, a means 40 for limiting rotation of drill box 20, and a means 70 for resiliently supporting drill box 20. Bottom support structure 32 comprises a bottom linkage plate 28 connectable to the main body of a mining bolter machine (not shown) in any manner known in the art, and supports and is connected to a bottom support plate 34 by bolts 36. A means for stopping downward motion of the drill box comprises a bumper or stop 38 that rests on bottom linkage plate 28 and is made of shock absorbing material.

Means 40 for limiting rotation of drill box 20 relative to the support plate comprises a stop rod 42 that extends downwardly from drill box 20 into a hole 44 in support plate 34 that has a diameter larger by a selected amount than the diameter of the rod. Hole 44 receives a cylindrical bushing 46 made of any suitable material sufficiently resilient to permit some lateral movement of stop rod 42 within hole 44.

Means 70 for resiliently supporting drill box 20 comprises an extension lip structure 72 extending downwardly from the bottom of drill box 20 that is positioned to contact stop 38 when forced toward it, and a resilient spring washer 74 generally positioned about the axis of rotation of the drill steel between drill box 20 and support plate 34 and looped over lip structure 72. The spring washer is biased to lift and positioned to support drill box 20 above support plate 34 by its spring action. Means for holding the drill box in place and for biasing the drill box to place drill steel 22 in a vertical position comprises a bolt 77 and washer 75 connected to lip structure 72 and passed through a hole 76 in bottom support plate 28 and bumper 38. Bolt 77 is tapped into lip 72 and is smaller in diameter than hole 76 to permit some lateral movement. Bolt 77 may be tightened to load spring washer 72 to align the drill box with support plate 24 and place drill steel 22 in a vertical position.

During operation of the drilling mechanism hydraulic motor 24 rotates drill steel 22 through drill chuck 26. The drill box rests upon bottom support plate 34 through spring washer 74 which holds the drill box generally in a vertical position above stop 38. The drill box may ride loosely on spring washer 74 or it may be placed under a selected tension by tightening bolt 77. During drilling drill box 20 is able to move angularly in any direction because of the resilience of spring washer 74 and the absence of other restraints and laterally because rod 42 and bolt 77 are movable within holes 44 and 76, respectively.

Referring to FIGS. 3 and 4, three spring washers 174 are positioned around the center line of the drill steel on a support plate 134. The washers are retained in place by pins 142 that extend downwardly from a drill box. The drill box is held in placed by any suitable means such as a bolt arrangement as shown in FIG. 1. The three washers provide greater and more evenly distributed support where desirable.

Referring to FIG. 5, a drilling mechanism 200 includes a drill box 210, a drill carrier support structure 212 having side walls 214 and a bottom support plate 216, rod extension and lip assemblies 218 that are connected to the drill box by bolts 219 and that extend into holes 220 in the support plate, a bumper and stop structure 203 having a bottom plate 232, a stop 234 and a center extension 236 on drill box 210, and a double spring washer assembly having a top spring washer 241 and a bottom spring washer 242. The arrangement of the double spring washer provides greater springing strength for the drill box.

I claim:

1. A drilling mechanism for a mining bolter machine comprising:

a support plate connected to a mining bolter machine, a spring washer mounted on the support plate, a drill box resting on the spring washer, and a means for preventing rotation of the drill box relative to the support plate.

2. A drilling mechanism according to claim 1 also comprising a means for holding the drill box in place on the support plate.

3. A drilling mechanism according to claim 2 also comprising a means for stopping downward motion of the drill box.

4. A drilling mechanism according to claim 2 wherein said means for preventing rotation comprises a downwardly extending rod positioned on the drill box and a hole in the support plate positioned to engage the rod with said hole having a diameter larger than the rod diameter by a selected amount.

5. A drilling mechanism according to claim 1 also comprising a means for stopping downward motion of the drill box.

6. A drilling mechanism according to claim 1 wherein said means for preventing rotation comprises a downwardly extending rod positioned on the drill box and a hole in the support plate positioned to engage the rod with said hole having a diameter larger than the rod diameter by a selected amount.

7. A drilling mechanism for a mining bolter machine comprising:

a support plate connectable to a mining bolter machine, a drill box having a drilling chuck for rotating a drill steel about an axis of rotation, said drill box positioned to be supported by the support plate;

a spring washer positioned between the drill box and the support plate and generally about the axis of rotation of the drill steel, and a means for preventing rotation of the drill box relative to the support plate.

8. A drilling mechanism according to claim 7 also comprising a means for holding the drill box in place on the support plate.

9. A drilling mechanism according to claim 7 also comprising a means for stopping downward motion of the drill box.

10. A drilling mechanism according to claim 7 wherein said means for preventing rotation comprises a downwardly extending rod positioned on the drill box and a hole in the support plate positioned to engage the rod.

11. A drilling mechanism for a mining bolter machine comprising:

a support plate connectable to a mining bolter machine, a drill box having a drill chuck for rotating a drill steel about an axis of rotation, said drill box positioned to be supported by the support plate;

a plurality of spring washers positioned between the drill box and the support plate and displaced away from the axis of rotation of the drill steel, and a means for preventing rotation of the drill box relative to the support plate.

12. A drilling mechanism for a mining bolter machine comprising:

a support plate connected to a mining bolter machine, a spring washer mounted on the support plate, a drill box resting on the spring washer having a vertically extending drill steel, and a means for biasing the drill box to place the drill steel in a vertical position.

13. A drilling mechanism according to claim 12 wherein said means for biasing comprises a device to load the spring washer.

14. A drilling mechanism according to claim 13 wherein said device to load comprises a bolt connected between the support plate and the drill box that may be tightened to load the spring washer.

* * * * *